US005212463A

United States Patent [19]

Babbitt et al.

[11] Patent Number: 5,212,463

[45] Date of Patent: May 18, 1993

[54] PLANAR FERRO-ELECTRIC PHASE SHIFTER

[75] Inventors: Richard W. Babbitt, Fair Haven; William C. Drach, Trenton; Thomas E. Koscica, Clark, all of N.J.

[73] Assignee: The United States of America as represented by the Secretary of the Army, Washington, D.C.

[21] Appl. No.: 916,741

[22] Filed: Jul. 22, 1992

[51] Int. Cl.[5] ..... H01P 1/18

[52] U.S. Cl. ..... 333/161

[58] Field of Search ..... 333/161, 156, 157, 164, 333/158, 159, 160, 250, 35, 33; 343/754, 909, 756

[56] References Cited

U.S. PATENT DOCUMENTS 4,105,959 8/1978 Stachejko ..... 333/161

5,032,805 7/1991 Elmer et al. ..... 333/156

*Primary Examiner*—Robert J. Pascal

*Assistant Examiner*—Ali Neyzari

*Attorney, Agent, or Firm*—Michael Zelenka; William H. Anderson

[57] ABSTRACT

A planar ferro-electric phase shifter which is compatible with commonly-used microwave transmission media to include microstrip, inverted microstrip, and slot line. The ferro-electric material, $Ba_xSr_{1-x}TiO_3$, which has a high dielectric-constant, is the phase shifting element. In the microstrip embodiment, the microstrip circuit consists of a ferro-electric element interposed between a conductor line and a ground plane. A DC voltage is applied between the conductor line and the ground plane, thereby controlling the dielectric constant of the ferro-electric material. The dielectric constant of the ferro-electric element in turn controls the speed of the microwave signal, which causes a phase shift. Microwave energy is prevented from entering the DC supply by either a high-impedance, low pass filter, or by an inductive coil. DC voltage is blocked from traveling through the microstrip circuit by a capacitive high-voltage DC bias blocking circuit in the ground plane.

10 Claims, 5 Drawing Sheets

PLANAR FERRO-ELECTRIC PHASE SHIFTER

GOVERNMENT INTEREST

The invention described herein may be manufactured, used, and licensed by or for the Government of the United States of America for governmental purposes without the payment to us of any royalty thereon.

BACKGROUND OF THE INVENTION

1. Field of the Invention

The invention relates to electronically.-controlled phase shifting of microwave signals. This technology is widely used for steering microwave beams in scanning antenna radar systems.

2. Description of the Prior Art

An inexpensive, easily manufacturable alternative to ferrite phase shifters is needed for steering microwave radar beams. Phase shifting in radars is normally accomplished using magnetic ferrite-dielectric composites which must be manually assembled. This assembly greatly increases the cost of these components. Additionally, ferrite-dielectric composite phase shifters are relatively heavy, large, and are susceptible to shock. An improvement to a magnetic ferrite-dielectric composite phase shifter is a ceramic phase shifter. U.S. Pat. No. 5,032,805, granted to Elmer et al. disclosed a voltage-controlled ceramic phase shifter. This patent employed strontium-barium titanate as the active material. Ceramics, however, are not an accepted microwave media. Additionally, they require embedding in compounds which makes assembly difficult, and require the careful selection of filler compounds with low microwave losses and matching coefficients of expansion. U.S. Pat. No. 5,032,805 did discuss a stripline application of the Elmer phase shifter, but relied on impedance matching wedges rather than the preferable $\lambda/4$ wave transformer impedance matching technique disclosed in the present invention. Additionally, the DC blocking function in U.S. Pat. No. 5,032,805 is accomplished with a capacitor, which being exposed to air, is subject to arcing. The present invention relies instead on a DC blocking circuit in its ground plane which is enclosed in silicone to allow the use of higher voltages.

SUMMARY OF THE INVENTION

The first general purpose of this invention is to provide a novel planar ferro-electric phase shifter which is compatible with commonly-used microwave transmission media to include microstrip, inverted microstrip, and slot line. The ferro-electric element which induces the phase shift is $Ba_xSr_{1-x}TiO_3$ the properties of which have been described in more detail above. The term ferro-electric element means an element fabricated from material that possesses an extremely high dielectric constant.. In the case of $Ba_xSr_{1-x}TiO_3$, the dielectric constant ranges from 200 to 5,000 depending on the Ba, Sr, and $Tio_3$ composition ratio. $Ba_xSr_{1-x}TiO_3$ is an amorphous, rigid ceramic solid prepared using standard ceramic processing techniques. Its amorphous nature causes it to not have a preferred axis at zero volts, i.e., at zero volts the dielectric constant is uniform in all directions. Under voltage, the dielectric constant of the ferro-electric element is reduced along the direction of the electric field caused by the applied voltage. The ferro-electric element, of course, has dielectric constants in the x, y, and z axes; under voltage, the dielectric constants along directions perpendicular to the electric field caused by the applied voltage remain unchanged.

In the microstrip embodiment, the microstrip circuit consists of a ferro-electric element interposed between a conductor line and a ground plane. The microwave signal passes through an impedance transformer which matches the microwave signal into the ferro-electric element, thereby reducing signal reflection. The microwave signal emerges from the transformer and travels through the ferro-electric element between the conductor line and the ground plane. A DC voltage is applied between the conductor line and the ground plane, thereby controlling the dielectric constant of the ferro-electric material. The dependency between the dielectric constant and the applied voltage is an inverse square root relationship, i.e., $$\lambda = \frac{\lambda o}{\sqrt{\epsilon_r}},$$

, where $\lambda o$ = the wavelength in a vacuum, $\lambda$ = the wavelength in the ferro-electric material, and $\epsilon_r$ = the relative dielectric constant. The dielectric constant of the ferro-electric element in turn controls the speed of the microwave signal, which causes a phase shift. DC voltage is supplied by an outside DC power supply. Microwave energy is prevented from entering the DC supply by either a high-impedance, low pass filter, or by an inductive coil. DC voltage is blocked from traveling through the microstrip circuit by a capacitive high-voltage DC bias blocking circuit in the ground plane. The DC voltage blocking circuit is based on an article by Thomas Koscica entitled "High Voltage DC Block for Microstrip Ground Planes", published in *Electronics Letters*, Aug. 2, 1990, Vol. 26 No. 16, and employs an insulating layer of silicone to prevent air arcing.

A second objective of the present invention permits phase shifters to be manufactured with a minimum of assembly, resulting in a fully functional phase shifter that is lighter and smaller than magnetic ferrite-dielectric composite phase shifters. The invention allows the manufacture of 360° X-band planar ferro-electric phase shifter which is 1 inch long with a 1300×1020 micron cross section. Additional objects of the present invention are to provide a ferro-electric phase shifter that is more rugged and requires lower drive power than magnetic ferrite-dielectric composite phase shifters.

BRIEF DESCRIPTION OF THE DRAWINGS

Other objects and many of the attendant advantages of this invention will be readily appreciated as the same becomes better understood by reference to the following detailed description when considered in connection with the accompanying drawings in which like reference numerals designate like parts throughout the figures thereof.

DETAILED DESCRIPTION OF THE PREFERRED EMBODIMENT

Figure 1:
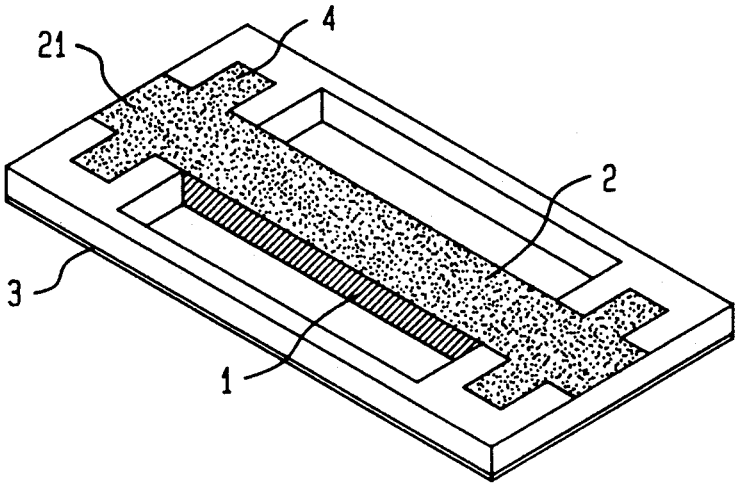
FIG. 1 is three-dimensional pictorial view of a microstrip embodiment of the invention.
Figure 2:
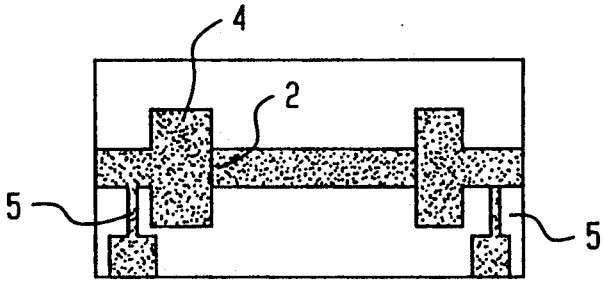
FIG. 2 is a top pictorial view of the microstrip embodiment of the invention depicting the placement of a $\lambda/4$ wave shunt low-pass filter.

Referring now to the drawings there is shown in FIG. 1 a three-dimensional view of the proposed ferro-electric microstrip planar phase shifter, which is the preferred embodiment. It uses a high dielectric constant, ferro-electric element (1), $Ba_xSr_{1-x}TiO_3$ as the phase shifting element. In the microstrip phase shifter, a microwave signal travels through the microstrip circuit (21), reaches the ferro-electric element (1) where it first travels through a $\lambda/4$ wave transformer so it can enter the low impedance ferro-electric element with minimum reflection. The microstrip circuit consists of a low-loss, low dielectric constant—(<20) - material between a conductor line (2) and a ground plane (3). The microwave signal travels in the ferro-electric element (1) between the conductor line (2) and the ground plane (3). When using a 50 Ohm microstrip circuit, it is necessary to have a $\lambda/4$ matching transformer (4) to match the microwave signal into the low impedance ferro-electric phase shifter element. The length of the ferro-electric element (1) is determined by the amount of phase shift required and the phase shift generated per unit length. While in the ferro-electric element (1) the propagation speed of the microwave signal is affected by changes in the dielectric properties of the ferro-electric element (1). The amount of phase shift generated is controlled by a DC voltage between the conductor line (2) and the ground plane (3). This voltage changes the dielectric constant of the ferro-electric element (1), which varies the speed of the microwave signal traveling through the ferro-electric element (1), causing a phase shift. DC voltage is supplied by an external DC power supply.

Figure 3:
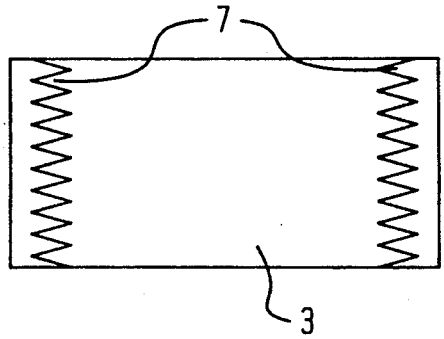
FIG. 3 is a bottom pictorial view of a microstrip embodiment of the invention depicting the high-voltage DC bias blocking circuit.
Figure 4:
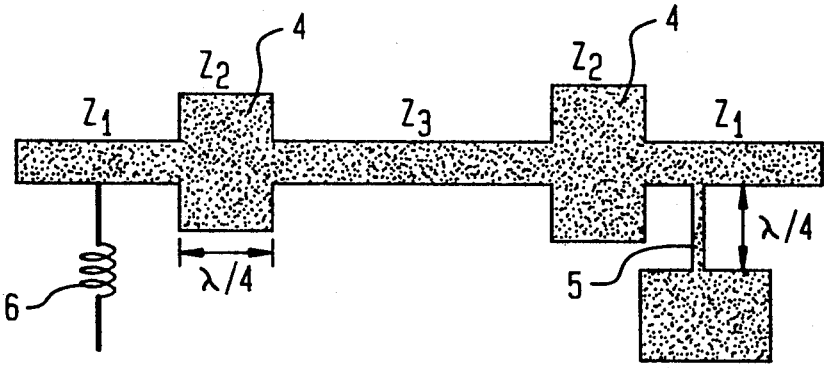
FIG. 4 is schematic depiction of the impedance matching circuit in the microstrip embodiment of the invention.
Figure 5:
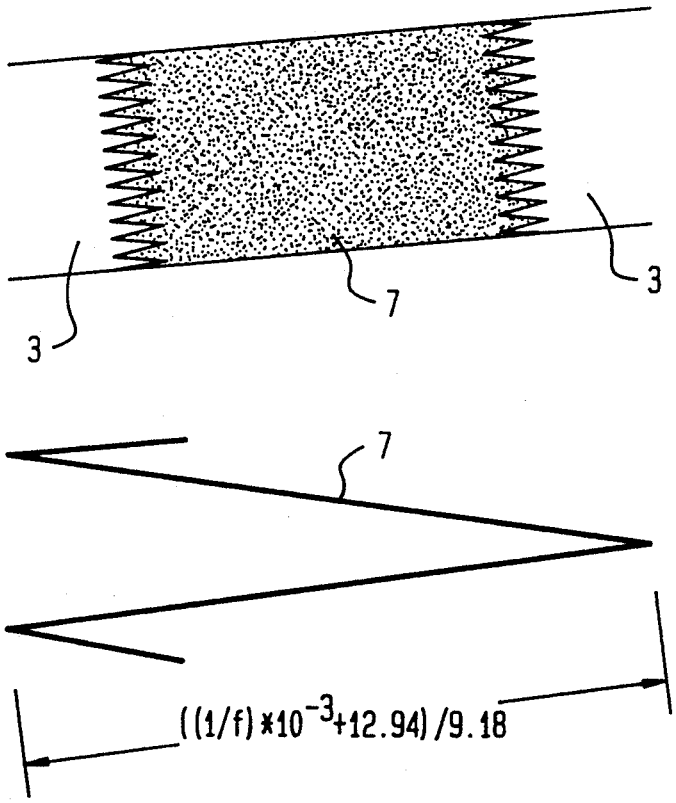
FIG. 5 is an enlarged pictorial depiction of a single slot in the high-voltage DC bias blocking circuit depicted in FIG. 3.

FIG. 3 is a view of the blocking circuit located on the bottom surface of the ground plane of the microstrip phase shifter. The DC voltage is blocked from traveling through external connecting circuits by a capacitive high-voltage DC blocking circuit (7) in the ground plane. FIG. 5 provides a greatly enlarged detailed view of a slot in the blocking circuit. FIG. 4 depicts in detail a matching circuit with formula for impedance matching requirements. Microwave energy is prevented from entering the DC supply by a high impedance, $\lambda/4$ wave shunt low-pass filter (5) or an inductive coil (6). [The formula for determining impedance matching is $Z_2=\sqrt{Z_1 Z_3}$ where $Z_1$ is the impedance of the microstrip (21), $Z_2$ is the impedance of the $\lambda/4$ wave transformer (4), and $Z_3$ is the impedance of the ferro-electric (1).]

Figure 6:
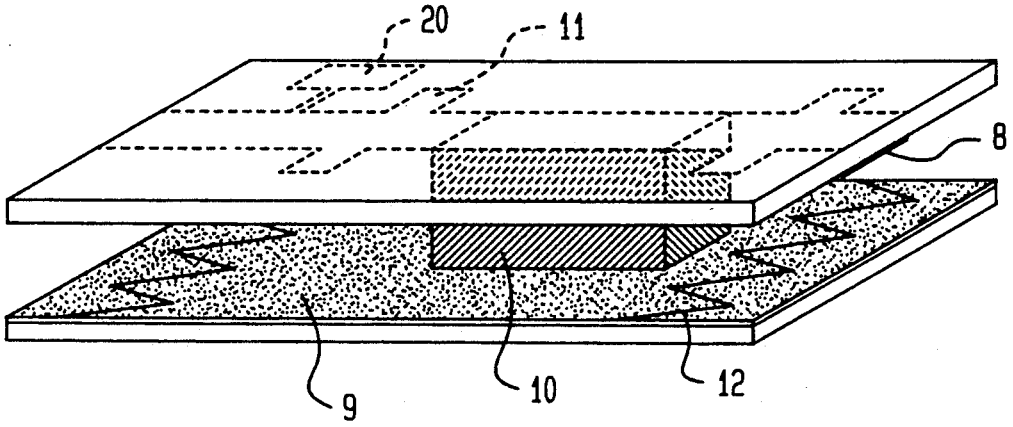
FIG. 6 is a top pictorial view of an inverted microstrip embodiment of the invention.
Figure 7:
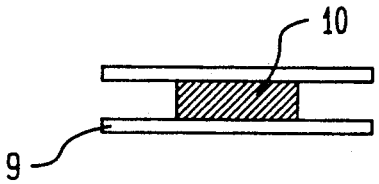
FIG. 7 is a side pictorial view of an inverted microstrip embodiment of the invention.
Figure 8:
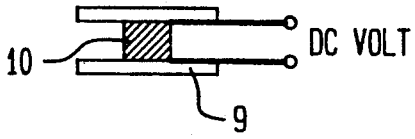
FIG. 8 is a front pictorial view of an inverted microstrip embodiment of the invention.
Figure 9:
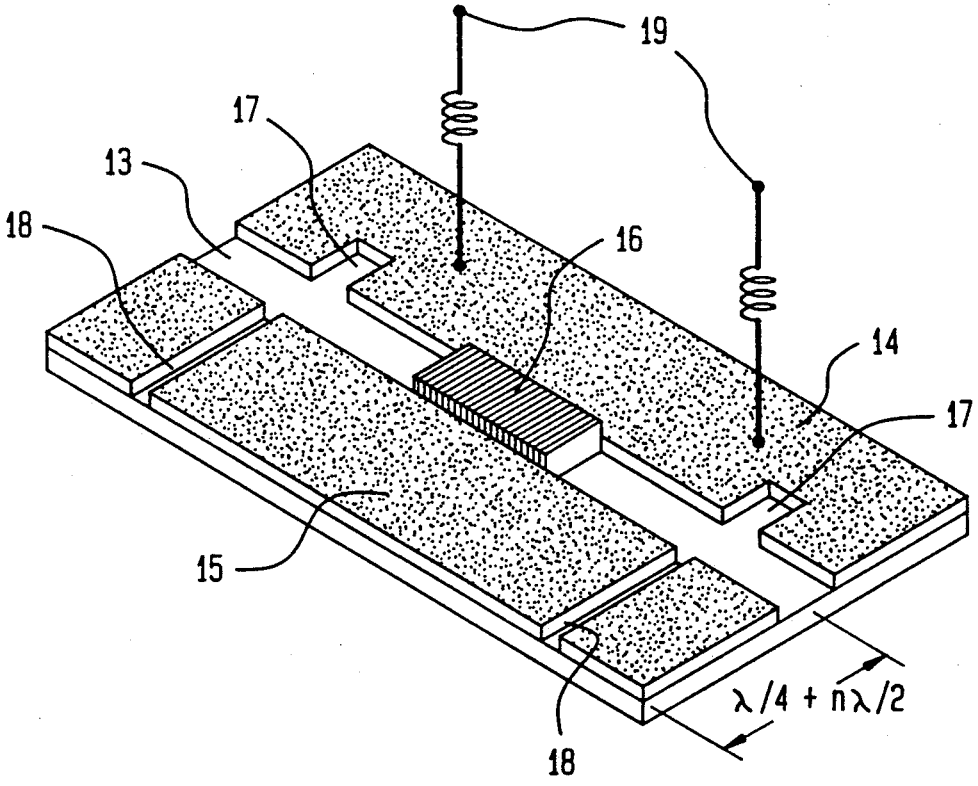
FIG. 9 is a top pictorial view of a slotline embodiment of the invention.

FIG. 6 depicts a ferro-electric inverted microstrip phase shifter. Like a microstrip phase shifter, it is composed of a conductor circuit (8) and a ground plane (9), however there is no dielectric between the conductor circuit (8) and the ground plane (9). The microwave signal travels in the air between the conductor circuit (8) and ground plane (9). The ferro-electric element (10) is placed between the conductor circuit (8) and the ground plane 9), using an impedance matching transformer (11) similar to that used in the microstrip phase shifter, which allows the signal to enter the ferro-electric element (10). Also, similar to the microstrip phase shifter, a $\lambda/4$ wave shunt low-pass filter (20) and a DC blocking circuit (12) are required. FIG. 9 depicts a slotline circuit type of planar ferro-electric phase shifter. A slotline circuit consist of a dielectric ferro-electric element (16) which has a length in the series $n1/2\ \lambda$, i.e., $1/2\ \lambda$, $\lambda$, $3/2\ \lambda$, etc., affixed to a slot (13) that is interposed between a conductor circuit (14) and a ground plane (15). The width of slot (13) is commonly selected to produce a 50 Ohm circuit. The ferro-electric element (16) is fixed into the slot with a fixed length matching transformer slot (17). The DC blocking circuit is created by two narrow (50 to 127 micron) gaps (18) in the ground plane, which need a length given by the series $(\lambda/4+n\lambda/2)$. The high DC voltage feed is a coil (19) which allows the DC signal to pass while acting as an open circuit for the microwave signal.

It is to be understood that other features are unique and that various modifications are contemplated and may obviously be resorted to by those skilled in the art. Therefore, within the scope of the appended claims, the invention may be practiced otherwise than as specifically described.

What is claimed is:

1. A ferro-electric phase shifter comprising:

a conductor line;

a ground plane;

a means for applying a DC current between said conductor line and said ground plane;

a ferro-electric element of a material possessing a high dielectric constant that can be varied by applying a DC voltage, said ferro-electric element being interposed between said conductor line and said ground plane to form a microstrip circuit, and said ferro-electric element having an entry point and exit point;

a means integral to said ground plane for blocking DC voltage from traveling through said conductor line, said ferro-electric element, and said ground plane;

an impedance matching circuit functionally interposed between said conductor line and said entry point of said ferro-electric element, wherein said impedance matching circuit reduces the signal reflection of a microwave signal traveling through the conductor line and into said ferro-electric element by matching the impedance of said microwave signal to that of said ferro-electric element; and a high-impedance, low pass filter coupled to said ground plane wherein said filter prevents microwave energy from entering the DC voltage applying means.

2. A ferro-electric phase shifter comprising:

a conductor line;

a ground plane;

a means for applying a DC current between said conductor line and said ground plane;

a ferro-electric element of a material possessing a high dielectric constant that can be varied by applying a DC voltage, said ferro-electric element being interposed between said conductor line and said ground plane to form an inverted microstrip circuit, and said ferro-electric element having an entry point and exit point;

a means integral to said ground plane for blocking DC voltage from traveling through said conductor line, said ferro-electric element, and said ground plane;

an impedance matching circuit functionally interposed between said conductor line and said entry point of said ferro-electric element, wherein said impedance matching circuit reduces the signal reflection of a microwave signal traveling through the conductor line and into said ferro-electric element by matching the impedance of said microwave signal to that of said ferro-electric element; and a high-impedance, low pass filter coupled to said ground plane wherein said filter prevents microwave energy from entering the DC voltage applying means.

3. A ferro-electric phase shifter comprising:

a conductor circuit;

a ground plane;

a means for applying a DC current between said conductor line and said ground plane;

a ferro-electric element of a material possessing a high dielectric constant that can be varied by applying a DC voltage, wherein said ferro-electric element, said conductor circuit and said ground plane are arranged to form a slotline circuit, said ferro-electric element being interposed between said conductor circuit and said ground plane;

a means integral to said ground plane for blocking DC voltage from traveling through said conductor circuit, said ferro-electric element, and said ground plane; and a means for preventing microwave energy from entering said DC voltage applying means.

4. The ferro-electric phase shifter in claim 3 wherein said ferro-electric phase element has a length which is a multiple of one half the wavelength of a microwave signal.

5. The ferro-electric phase shifter in claim 4 wherein said ferro-electric element is fixed in the slot with a $\lambda/4$ fixed-length impedance matching slot.

6. The ferro-electric phase shifter in claim 5 wherein the slot in said slotline circuit is selected to produce a 50 Ohm circuit.

7. The ferro-electric phase shifter in claim 6 wherein said DC voltage blockage means is gaps in said ground plane,

8. The ferro-electric phase shifter in claim 16 wherein said DC voltage blockage means is two gaps in said ground plane, each of said gaps having a thickness of 50–127 microns.

9. The ferro-electric phase shifter in claim 8 wherein in each of said gaps has a length calculated by the series $(\lambda/4+n\ \lambda/2)$.

10. The ferro-electric phase shifter in claim 9 wherein said DC applying means is a coil which allows the DC signal to pass while acting as an open circuit for the microwave signal.

* * * * *